US006751836B2

(12) United States Patent
Smith

(10) Patent No.: US 6,751,836 B2
(45) Date of Patent: Jun. 22, 2004

(54) METHOD OF ENABLING THE SPACING OF METAL UNITS

(76) Inventor: Richard A. Smith, 608 S. Central Ave., Stafford, AZ (US) 85546

( * ) Notice: Subject to any disclaimer, the term of this patent is extended or adjusted under 35 U.S.C. 154(b) by 191 days.

(21) Appl. No.: 09/875,528

(22) Filed: Jun. 5, 2001

(65) Prior Publication Data

US 2002/0005059 A1 Jan. 17, 2002

Related U.S. Application Data

(60) Provisional application No. 60/217,637, filed on Jul. 11, 2000.

(51) Int. Cl.[7] ..... B23P 23/00

(52) U.S. Cl. ..... 29/401.1; 414/785.2

(58) Field of Search ..... 29/596, 401.1, 29/525, 521, 292, 592.1, 469, 505, 554; 414/785.2, 790.2, 790.4, 766; 72/379.2; 364/478.01; 204/292, 280

(56) References Cited

U.S. PATENT DOCUMENTS

| | | | | | |
|---|---|---|---|---|---|
| 2,062,099 | A | * | 11/1936 | MacChesney | 24/23 W |
| 4,131,531 | A | * | 12/1978 | Kaneko et al. | 204/208 |
| 4,555,942 | A | * | 12/1985 | Ludvigsson | 73/433 |
| 5,670,033 | A | * | 9/1997 | Burgess et al. | 205/74 |
| 5,793,637 | A | * | 8/1998 | Clayton et al. | 700/213 |
| 5,918,359 | A | * | 7/1999 | Neuenschwander | 29/564.2 |
| 5,992,003 | A | * | 11/1999 | Elliott et al. | 29/596 |
| 6,139,974 | A | * | 10/2000 | Atkinson et al. | 428/595 |
| 6,223,417 | B1 | * | 5/2001 | Saban et al. | 29/598 |
| 6,276,044 | B1 | * | 8/2001 | Ragland et al. | 29/521 |

* cited by examiner

*Primary Examiner*—David P. Bryant
*Assistant Examiner*—Stephen Kenny

(57) ABSTRACT

The invention provides methods and devices that enable the spacing of metal units. One method generally identifies a dimple location on a metal unit, and applies a force at the dimple location to create a spacing feature. In another embodiment, the invention is a spacable metal sheet having thereon a spacing feature. The spacable metal sheet is preferably embodied as a copper cathode.

13 Claims, 2 Drawing Sheets

Figure 1
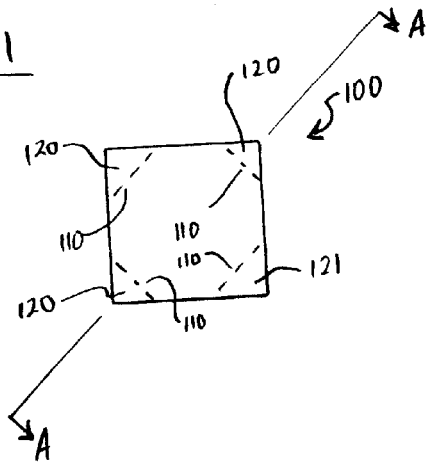
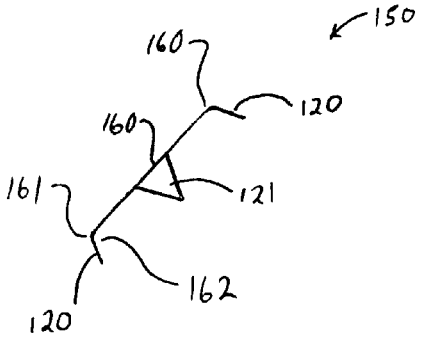
Fig. 2
Fig. 3
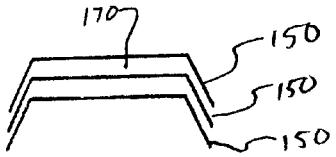
Fig. 4
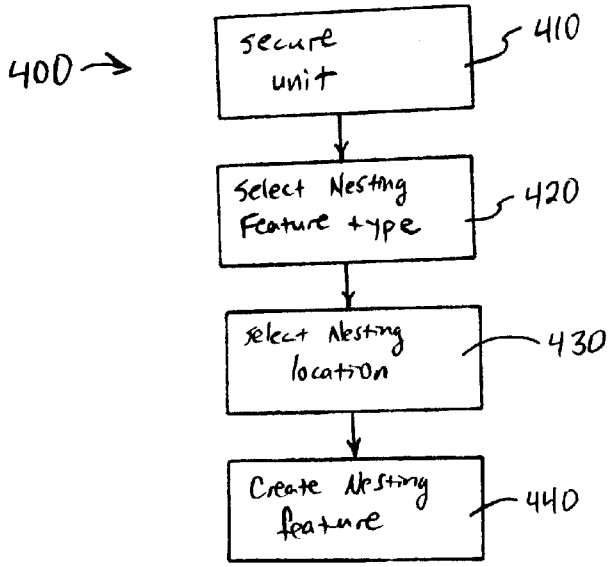

METHOD OF ENABLING THE SPACING OF METAL UNITS

CROSS REFERENCE TO RELATED APPLICATIONS

The invention is related to and claims priority from U.S. Provisional Patent Application No. 60/217,637, filed On Jul. 11, 2000, by Richard A. Smith, and entitled Cathode Nesting Press. The invention is also related to and claims priority from U.S. patent application Ser. No. 09/848,189, filed on or about May 13, 2000, by Richard A. Smith, and entitled Method Of Enabling The Nesting Of Metal Units.

BACKGROUND OF THE INVENTION

1. Technical Field of the Invention

The invention relates generally to preparing metal units, such as metal plates, so that they will be properly spaced when stacked. More specifically, the invention relates to preparing copper cathodes so that they may be stacked for better/optimal melting, or for better/optimal chemical reactions.

2. Problem Statement

Metal plates (also called sheets) are commonly used in industrial applications. For example, some copper metal sheets may be used as copper cathodes in mining operations. In addition, zinc metal sheets are used as anodes in industrial water applications to prevent the "pitting" of a metallic container.

Accordingly, in the mining industry, the copper cathodes are used in copper bearing solutions of sulfuric acid and water. More specifically, a copper leaching process called SXEW (solvent extraction/electrowinning) is used at most copper mines to extract copper from oxide ores. In practice, this process (called leaching) runs acid and water through a pile or dump of copper bearing oxide ore, and collects the resulting solution for further processing. Accordingly, copper mining and many other industrial processes utilize a large number of metal plates.

Sometimes, due to size limitations, space needed in an industrial application, melting qualities, or other factors, a metallic rod is preferable to a metal plate. Accordingly, sometimes the word "metal unit" is used to describe a metal plate (metal sheet), metal rod, or any other type of stackable metallic processing pieces.

Bundling is the process of gathering and stacking metal units for transport or storage (thus creating a "bundle" of metal units). Although bundling may be interpreted by some to imply the application of a securing device to a bundle, as used herein, bundling means the association of two or more metal units, regardless of purpose. Typically, although not necessarily, the association is a stacking of the metal units.

Unfortunately, many metal units are destroyed or lost in transport between a manufacturing or storing site, and an industrial location that utilizes the metal units. This is because securing devices, such as metal bands, that are used to support metal units in transport are often insufficiently strong to withstand the forces and momentum generated by otherwise apparently static metal units. Accordingly, shearing and other forces often cause metal bands to break, or may cause a stack of metal units to fall over. Accordingly, many metal units fall off trucks, trains, or other transport vehicles. Furthermore, stacks of metal units may fall, or slide in a one-on-top-of-each-other fashion, and damage facilities or equipment. Therefore, it would be advantageous to have methods for bundling metal units that more securely maintain the metal units in a stack or other position.

Sometimes, when stacking metal units, the weight of the metal unit itself will cause the center portion of the metal unit to sag. Occasionally, the sagging will be severe enough to cause one metal unit to touch another metal unit. This sagging may result in unpredictable spacing between metal units. Because the spacing between metal units is unpredictable, physical and chemical properties of the reactions involving the metal units are not predictable. For example, unpredictable spacing of metal units makes it difficult to predict heat dissipation, and therefore, the melting properties of the metal units are also unpredictable. In addition, the unpredictable spacing of metal units creates uncertainty in chemical flow between metal units that are undergoing a chemical reaction. Therefore, for these and other reasons it would be advantageous to have methods for spacing metal units in a stack or other position.

SUMMARY OF THE INVENTION

The invention provides technical advantages as methods and devices that enable the spacing of metal units. In one embodiment, the invention is a method of modifying a metal unit to enable spacing. The method generally identifies a dimple location on the metal unit, and applies a force at the dimple location to create a spacing feature.

The method may also include selecting a spacing feature type—such as a dimple, a bubble, a rib, or an impression. In addition, the plurality of dimples may be used. For example, three dimples spaced approximately at the corners of an equilateral triangle, or four dimples spaced approximately at the corners of a square, may be centered about the midpoint of a metal unit to provide for predictable and reliable spacing. The metal unit may be a metal plate, such as a copper cathode, or zinc anode.

In another embodiment, the invention is a nestable and spacable metal sheet. The metal sheet is preferably a copper cathode. Furthermore, the metal sheet may have nesting features such as a generally polygonal impression.

In yet another embodiment, the invention is a nestable copper cathode for use in sulfuric acid bearing solutions, comprising a nesting feature and a spacing feature, the spacing feature comprising at least one dimple. Of course, other features and embodiments of the invention will readily apparent to those of ordinary skill in the art, and thus, similar results as described herein can be achieved in not dissimilar manners. Accordingly, the following discussion should not be read as limiting, and the scope of the invention should be read as limited only as defined in the CLAIMS.

DESCRIPTION OF FIGURES

The invention is best understood by reference to the following detailed description, which should be read in conjunction with the accompanying drawings, wherein:

FIG. 1 is a top down view of a metal unit;

FIG. 2 is a cut-view of the metal unit taken across the diagonal cut line AA;

FIG. 3. illustrates a plurality of nestable metal units that are nested together;

FIG. 4. illustrates a create nestable metal unit algorithm;

DETAILED DESCRIPTION

Figure 5:
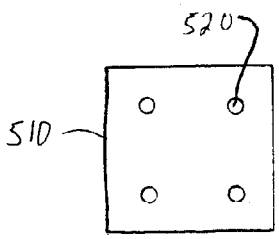
FIG. 5 illustrates a top down view of a metal unit.

A nestable metal unit is a metal until that has features that enable the metal unit to be securely bundled without the use of a securing device. Accordingly, the invention provides methods of modifying metal units, as well as the metal units themselves, which are nestable and may have controlled spacing. In general, to create a nestable metal unit, a common nesting location is identified on a first metal unit (it is "common" in the sense that the other metal units that are nestable with the first metal unit will have a similar nesting feature at about the same location; furthermore, the metal units should include a complementary nesting feature-one that mates with the nesting feature—at a location that mates with the nesting location of the first metal unit). Then, a force is applied at the nesting location to create a nesting feature.

Accordingly, a nestable metal unit generally is a metal plate (or metal sheet) having a nesting feature at a common location. When using a nesting feature, metal units may be bundled by nesting such that a nestable feature of a first metal unit snuggly fits into a complementary nestable feature of a second metal unit. In practice, nesting metal plates secures the plates much more effectively than bundling the metal plates, and then tying the metal plates with a metal band. In fact, in some embodiments, the weight and size of a metal unit becomes an advantage because larger and heavier metal units will have more force pushing them together, and therefore nest more securely.

The invention may be better understood by way of an illustration. Accordingly, FIG. 1 is a top-down view of a metal unit 100. Although the metal unit illustrated in FIG. 1 appears as a plate (or sheet), it should be understood that the principals taught by the invention may be applied to any other shaped metal unit, including rods. In addition, the material from which the metal unit is made is generally unimportant. However, for purposes of this embodiment that is directed at the copper mining industry, the metal unit is preferably a copper cathode. In an alternative embodiment, the metal unit is a copper metal rod.

The metal unit 100 has a plurality of nesting locations 110 identified thereon. In the preferred embodiment, the nesting locations are lines made at each corner of the copper cathode, such that the line "cuts" the corner into an approximately isosceles triangle. Accordingly, each corner 120 of the copper cathode 100 may become a nesting portion of the metal unit, where a nesting portion is the structure that creates a nesting feature. A fourth corner 121 is distinguished from other corners 120 to clarify geometries illustrated in the second figure.

Accordingly, FIG. 2 is a cut-view of the metal unit 100 taken across the diagonal cut line AA. In FIG. 2, one may see that the basic shape of the metal unit 100 remains unchanged. However, at each nesting location 110, a nesting feature (namely a bend 160) has been produced.

Thus, as illustrated in FIG. 3, a preferred nesting feature is a bend. Accordingly, it may be seen that each bend 160 has an outside radius 161, and an inside radius 162 that is a different radius (smaller) than the inside radius 162. The disparity in radius size may be used as advantage of the invention, since the inside-outside radius differential creates a natural separation between the metal plates when the metal plates are stacked on top of each other. The space is typically about the width of the metal unit itself. Furthermore, the actual separation between the plates may be planned by adjusting the angles of the bends. In any event, metal plate separation enables the metal plates to be melted, or otherwise interact with their environment, more quickly than if the plates were merely stacked without separation. Among other benefits, this saves fuel and other energy cost.

It should be understood that many nesting features are possible. For example, one nesting feature may be created by "poking" a metal unit to create a dimple on one side of the cathode, and a bubble on the other side of the cathode. Other nesting features can be created by bending one side, two sides, or all four sides of the metal unit. Yet additional nesting features could be created by forming a polygonal impression on one side of a metal unit, and a corresponding raised polygonal structure on the other side of the metal unit. Similarly, another nesting feature may be built by creating a generally circular impression on one side of a metal unit, and a corresponding generally circular raised-structure on the second side of the metal until.

FIG. 4 illustrates a create nestable metal unit algorithm 400. The create nestable metal unit algorithm 400 begins with a secure unit act 410. In the secure unit act 410 the metal unit, irrespective of type, is securely positioned in a cathode nesting press. Then, in a select nesting feature type act 120 one may select the specific type of nesting feature they desire to apply to the metal unit. For example, one may choose to use dimples as a nesting feature. However, it is preferable that a single bend be made at a constant location at each corner of a metal unit.

This common location is selected in a select nesting location act 430. Preferably, on a copper cathode, the bend is located across each corner, approximately four inches from the corner. Of course, the selection of the nesting location will depend on the type of nesting feature one desires to use.

For example, should one choose to use a dimple nesting feature, it maybe more advantageous to select three nesting locations for each metal unit such that the nesting locations form the points of an equilateral triangle, centered about the center of the metal unit. Then, following the select nesting location act 430, the create nestable metal unit algorithm 400 proceeds to a create nesting feature act 440. In the create nesting feature act 440 the cathode nesting press is activated and the appropriate nesting feature is created in the metal unit. So, for example, if a "bend" nesting feature is desired, the cathode nesting press will bend the metal unit in the nesting location in the create nesting feature act 440. Alternatively, if a dimple is selected as the nesting feature the cathode nesting press will create the dimple(s) at the desired nesting location(s) in the create nesting feature act 440.

Sometimes, it is advantageous to provide spacing features to provide more predictable and controlled spacing between stacked metal plates. FIG. 5 illustrates a top down view of a metal unit 510 having spacing features 520 thereon. A spacing feature 520 should be placed at a location on the metal unit 510 that provides a logical structural weight support for the weight of the metal unit 510. In a preferred embodiment, for the metal unit 510, the spacing feature locations are co-located with the spacing features 520. Thus, the spacing features are located at spacing feature locations, and the spacing feature locations are spaced approximately a the corners of a square, and the square is approximately centered about mid-point of the metal unit. Of course, alternative placements of the spacing features are logical. For example, spacing features may be placed at spacing feature locations spaced approximately at the corners of an equilateral triangle, where the equilateral triangle is approximately centered about the mid-point of the metal unit. The size of the equilateral triangle, square, or other shape is selected as needed to provide adequate support. Of course, it is not necessary to have shape-selected spacing, and it should be understood that the random (or, apparently random) spacing of spacing features is within the scope of the invention.

Figure 6:
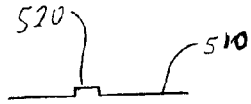
FIG. 6 illustrates the metal plate.
Figure 7:
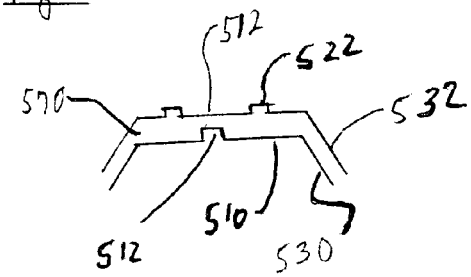
FIG. 7 generally illustrates the stacking of a first metal plate.

The type of spacing feature chosen may depend upon factors such as the size of the actual spacing desired, the weight of the metal plate(s) that must be supported, or a host of other factors that are well known in the art. FIG. 6 illustrates the metal plate 510 having the spacing feature 520 as a dimple. However, is should be understood that bubbles, ribs, polygonal impressions, circular impressions, or other types of indentions may be used to create spacing features. FIG. 7 generally illustrates the stacking of a first metal plate 510 and a second metal plate 512. The first metal plate 510 had a first bend 530 which is used as a nesting feature, and, likewise, the second metal plate 512 has a second bend 532, which acts as a nesting feature for the second metal plate 512. The first metal plate 510 has a spacing feature 512, embodied as a dimple. Likewise, the second metal plate 512 has a plurality of spacing features 522, embodied as dimples. When stacked one on top of the other, the result of the stacking configuration illustrated in FIG. 7 is the preservation of a predictable spacing 570. It should be understood that the spacing features and nesting features and spacing illustrated in FIG. 7 are not drawn to scale.

From FIG. 7 it should be understood that it is not necessary to apply the same spacing feature to every metal plate in a stack of metal plates. In addition, one should understand from FIG. 7 that it is not necessary to align the spacing features when stacking metal plates. However, it should also be understood that aligning spacing features and nesting features is a preferred embodiment of a method of the invention. Also, other configurations for stacking metal plates and for the organization of spacing features when stacking metal plates exist, and have many alternatives which will be readily apparent to those of ordinary skill in the art.

Figure 8:
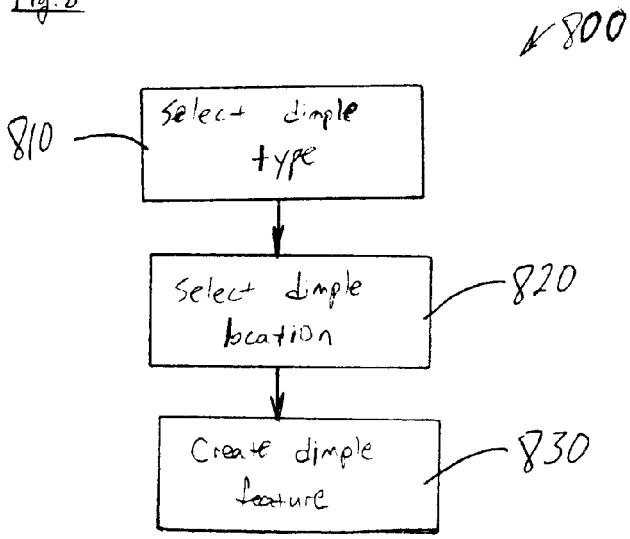
FIG. 8 illustrates a spacing algorithm.

The creation of a spacing feature may be achieved by a spacing algorithm. FIG. 8 illustrates a spacing algorithm 800. The spacing algorithm 800 begins with a select spacing feature type act 810. Accordingly, in the select spacing feature act 810, a spacing feature, such as a dimple, a bubble, a rib, a polygonal impression, a circular impression, or other impression, may be selected as a spacing feature type. Then, in a select spacing feature location act 820 a spacing feature location is chosen. In a preferred embodiment, the spacing feature location act 820 will place spacing features at approximately the corners of a square that is approximately centered about the mid-point of a metal unit. Preferably, the spacing feature type is a dimple. Next, the spacing algorithm 800 proceeds to a create spacing feature act 830. In the create spacing feature act 830 the appropriate spacing feature is created in the metal unit. This is typically achieved with a spacing feature press. Thus, if a dimple spacing feature is desired, the spacing feature press will impact the metal unit in the spacing feature location to create the spacing feature, such as a dimple.

Of course, it should be understood that the order of the acts of the spacing algorithm 800 may be accomplished in different orders depending on the preferences of those skilled in the art. Furthermore, it should be understood that the above discussion is merely a description of an embodiment, and that the invention is limited only by the following claims.

I claim:

1. A method of modifying a metal unit derived from an electrowinning process to adapt the metal unit for transport and to enable the controlled spacing of a plurality of metal units, comprising:

securing a metal unit created from an electrowinning process;

identifying a dimple location on the electrowon metal unit along a horizontal surface thereof; and applying a force at the dimple location to create a spacing feature.

2. The method of claim 1 further comprising securing a second metal unit upon the first metal unit by utilizing a nesting feature.

3. The method of claim 1 further comprising selecting a spacing feature type.

4. The method of claim 3 wherein the spacing feature is a dimple.

5. The method of claim 3 wherein the spacing feature comprises at least three dimples spaced approximately at the corners of an equilateral triangle, the equilateral triangle approximately centered about the midpoint of the metal unit.

6. The method of claim 3 wherein the spacing feature comprises at least four dimples spaced approximately at the corners of a square, the square approximately centered about the midpoint of the metal unit.

7. The method of claim 3 wherein the spacing feature is a bubble.

8. The method of claim 3 wherein the spacing feature is a rib.

9. The method of claim 3 wherein the spacing feature is a generally polygonal impression.

10. The method of claim 3 wherein the spacing feature is a generally circular impression.

11. The method of claim 1 wherein metal unit is a metal plate.

12. The method of claim 1 wherein the metal unit is a copper cathode.

13. The method of claim 1 further comprising applying a force at a nesting location to create a nesting feature.

* * * * *